US008683661B2

(12) United States Patent
Chen

(10) Patent No.: US 8,683,661 B2
(45) Date of Patent: Apr. 1, 2014

(54) PUSH BUTTON TYPE BELT BUCKLE

(71) Applicant: Hsi-Hsin Chen, New Taipei (TW)

(72) Inventor: Hsi-Hsin Chen, New Taipei (TW)

( * ) Notice: Subject to any disclaimer, the term of this patent is extended or adjusted under 35 U.S.C. 154(b) by 0 days.

(21) Appl. No.: 13/760,078

(22) Filed: Feb. 6, 2013

(65) Prior Publication Data

US 2014/0007384 A1 Jan. 9, 2014

(30) Foreign Application Priority Data

Jul. 5, 2012 (TW) ..... 101212957 A

(51) Int. Cl.
*A44B 11/00* (2006.01)
*A44B 11/24* (2006.01)

(52) U.S. Cl.
USPC ..... 24/188; 24/178; 24/163 R

(58) Field of Classification Search
CPC ..... A44D 2211/02; A42B 7/00; A63C 13/00
USPC ..... 24/188, 178, 181, 194, 265 R, 265 WS, 24/265 BC, 265 EC, 640, 641, 163 R, 656, 24/180, 494, 513, 568, 549.09, 579.11, 24/580.1, 591.1, 636
See application file for complete search history.

(56) References Cited

U.S. PATENT DOCUMENTS

| | | | | | |
|---|---|---|---|---|---|
| 1,786,115 | A | * | 12/1930 | Jensen | 24/656 |
| 2,901,806 | A | * | 9/1959 | Henshel | 24/265 R |
| 3,252,196 | A | * | 5/1966 | Ries | 24/656 |
| 3,579,750 | A | * | 5/1971 | Carbon et al. | 24/650 |
| 3,597,811 | A | * | 8/1971 | Cunningham | 24/650 |
| 3,871,090 | A | * | 3/1975 | Romanzi et al. | 200/61.58 B |
| 4,194,764 | A | * | 3/1980 | Grimm | 280/801.1 |
| 4,208,771 | A | * | 6/1980 | Biller | 24/656 |
| 4,245,376 | A | * | 1/1981 | Lassche | 24/639 |
| 4,374,449 | A | * | 2/1983 | Stephenson et al. | 24/656 |
| 4,408,374 | A | * | 10/1983 | Fohl | 24/650 |
| 4,490,892 | A | * | 1/1985 | Ueda | 24/641 |
| 6,367,129 | B1 | * | 4/2002 | Mori | 24/641 |

* cited by examiner

*Primary Examiner* — Robert J Sandy
*Assistant Examiner* — Rowland D Do
(74) *Attorney, Agent, or Firm* — Leong C. Lei

(57) ABSTRACT

A push button type belt buckle includes a moveable rod and a push button arranged to be interlaced with each other and configured to cooperate with spring mechanisms provided in a belt base. With such a unique structure, a buckling pin provided on the moveable rod is able to floatingly buckle a belt with ease while exhibiting an elastic characteristic capable of returning to its original position such that the adjustment of the extent of the fastening and buckling of the belt can be advantageously achieved via the push button reliably and such that the push button type belt buckle of the present invention is of the improved effects of facilitated operations and simplified assembly requirements and functions.

1 Claim, 8 Drawing Sheets

PUSH BUTTON TYPE BELT BUCKLE

TECHNICAL FIELD OF THE INVENTION

The present invention is related to a push button type belt buckle, in particular, to a belt buckle utilizing a moveable rod and a push button cooperating with positioning holes as well as spring mechanisms to achieve a buckling device with a reliable structure with facilitated operation and simplified structural assembly requirements.

DESCRIPTION OF THE PRIOR ART

Conventionally, belt buckles are used to form a belt hoop with the two ends thereof connected in a circle as a fastening or buckling means. The belt buckle is often designed to be arranged at one end of the belt while the other end of the belt surrounds the waist forming a hoop and passes through the belt buckle to be fastened thereon. Most currently available belt buckles adapts the design of using a buckling pin pinned into one of the locking holes provided on the belt or using a buckling slat snapped onto a locking block on the belt in order to achieve the buckling and fastening of the belt. Nevertheless, the use of the buckling pin with locking holes or the buckling slat with locking block often causes difficulties to the release of the belt when it is being overly fastened at a first place.

To improve the aforementioned drawback, it is known that a buckling mechanism with a floating type of buckling pin has been introduced to the market. Such buckling mechanism utilizes an elastic push button to move buckling pins that are being rotatably provided and configured on the belt to realize the floating type movement of the pins such that the buckling of the belt can be released promptly. However, this type of buckling pins are, in fact, using a clock spring to achieve the rotational returning movements back to the original position, which requires a large torque to be exerted via the push button with a great external force to accomplish the returning movements of the pins. In addition, such type of buckling mechanism is prone to be jammed during the release of the buckling of the belt, which makes it inconvenient to practical uses. Moreover, the angle of rotation of the buckling pins is found to be too small to generate a significant floating movement of the pins, which is very likely to cause loose connection and buckling between the pins and the belt. There is a need for an improved belt buckle to overcome the aforementioned drawbacks.

SUMMARY OF THE INVENTION

A primary objective of the present invention is to provide a belt buckle utilizing a push button to drive a moveable rod to suppress a spring mechanism such that said moveable rod rotates about said base to cause a floating movement of said buckling pin.

A secondary objective of the present invention is to provide a belt buckle wherein the moveable rod and the extension of the push button are provided with a positioning shaft mounted with a spring thereon respectively in order to offer buffering and feedback spring elasticity.

Accordingly, a push button type belt buckle of the present invention comprises a moveable rod provided in an internal of a belt base to utilize a slot cooperating with a vertical positioning surface of an extension of the push button and a slanted opening such that the push button is able to drive the extension to abut the moveable rod at a top thereof and the springs associated with the button and the moveable rods can provide necessary elasticity for the generation of floating movement of the buckling pin arranged therein in order to achieve the control and adjustment of the buckling of the belt thereby providing reliable structural functions with facilitated operations and simplified assembly requirements.

DETAILED DESCRIPTION OF THE PREFERRED EMBODIMENTS

Figure 1:
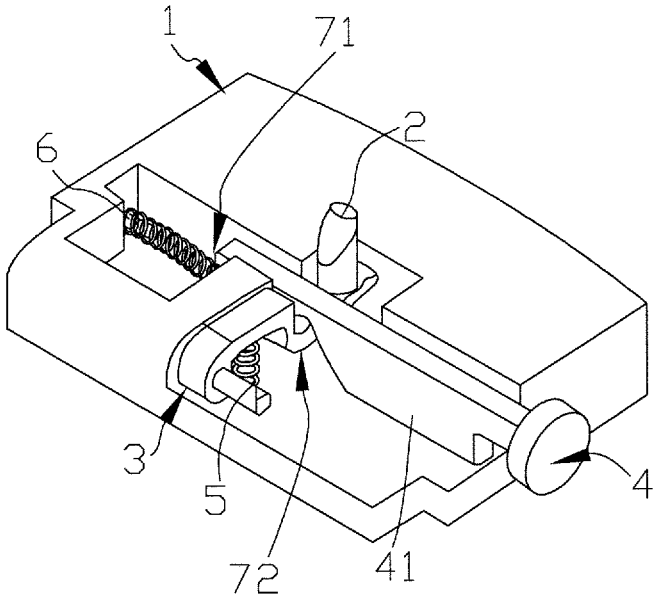
FIG. 1 is a perspective view of a push button type belt buckle of the present invention.
Figure 1A:
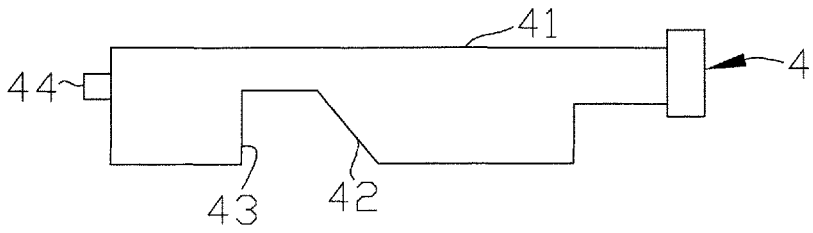
FIG. 1A is an illustration showing the push button mechanism of the belt buckle of the present invention.

Please refer to FIG. 1 to FIG. 4, in which an embodiment of the a push button type belt buckle of the present invention comprising a belt base 1, a moveable rod 3, a push button 4, an extension 41, a first spring mechanism 71, a second spring mechanism 72 is shown.

Figure 2:
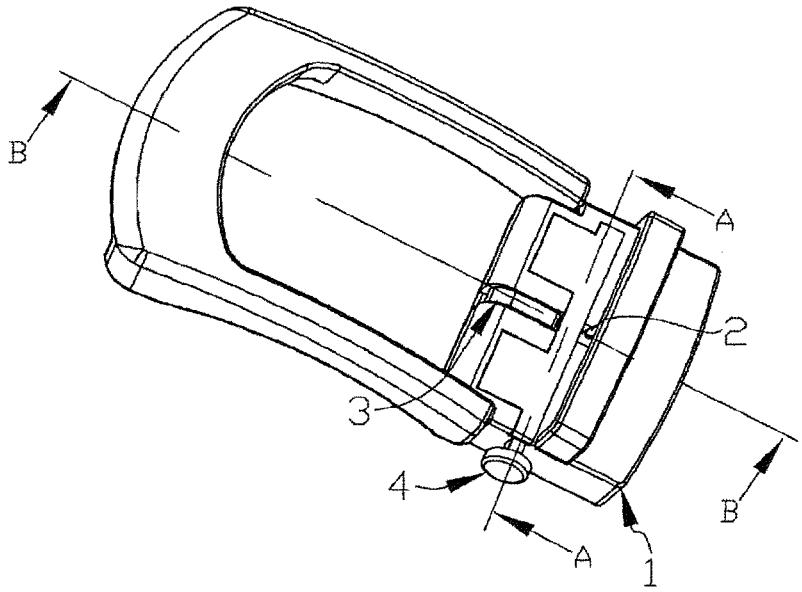
FIG. 2 is a top perspective view of the present invention.
Figure 2A:
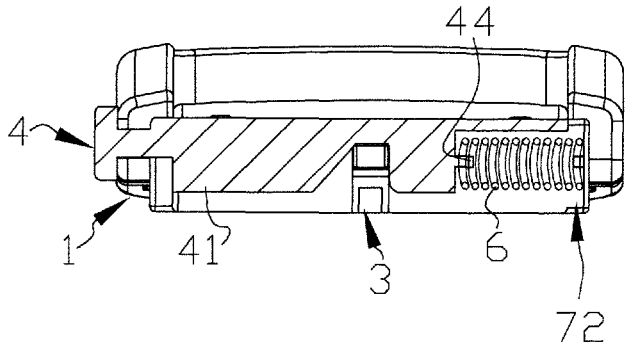
FIG. 2A is a cross sectional view taken along line A-A showing a non-activated operation of the push button of the belt buckle of the present invention.
Figure 2B:
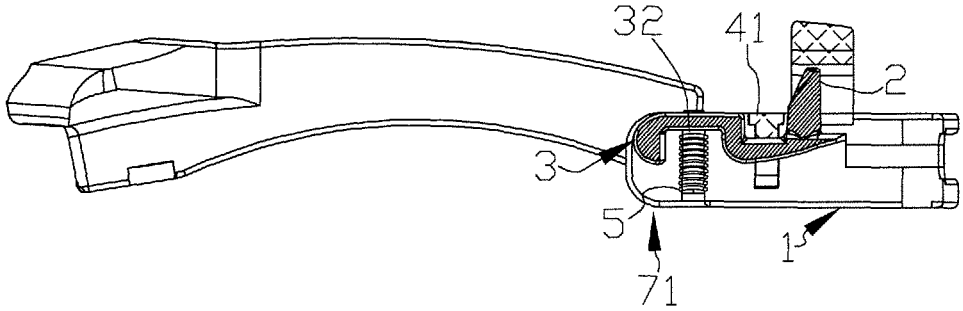
FIG. 2B is a cross sectional view taken along line B-B showing a non-activated operation of the push button of the belt buckle of the present invention.
Figure 2C:
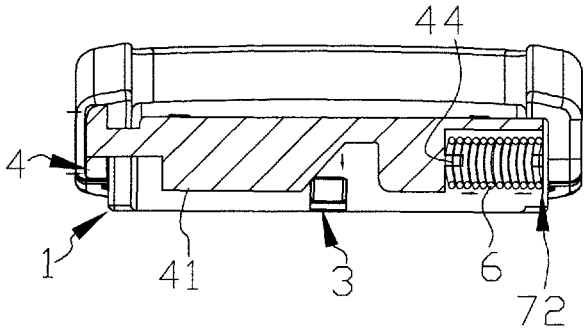
FIG. 2C is a cross sectional view taken along line A-A showing an activated operation of the push button of the belt buckle of the present invention.
Figure 2D:
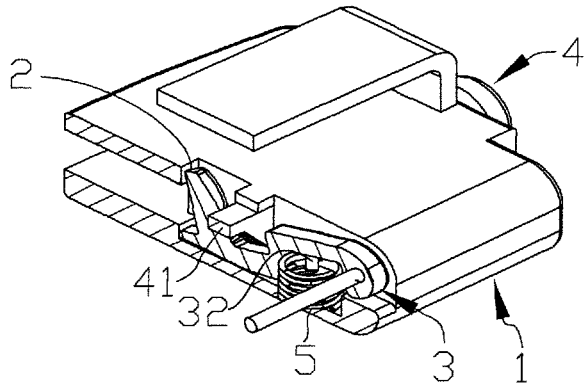
FIG. 2D is a cross sectional view taken along line B-B showing an activated operation of the push button of the belt buckle of the present invention.

As shown in FIG. 1 to FIG. 2D, a push button type belt buckle of the present invention comprises a belt base 1; a moveable rod 3 having a rear end provided with a rotating axle 31 configured to be correspondingly received in an internal of said belt base 1, a front end of said moveable rod 3 provided with a buckling pin 2 and a slot 33 and a bottom portion provided with a first spring 5 mounted onto a first positioning shaft 32 to form a second spring mechanism 72; a push button 4 having one side provided with an elongated extension 41 with a second spring 6 mounted onto a second positioning shaft 44 to form a first spring mechanism 71 and a central portion provided with a vertical positioning surface 43 and a slanted opening 42 corresponding to said slot 33 of said moveable rod 3.

Figure 1B:
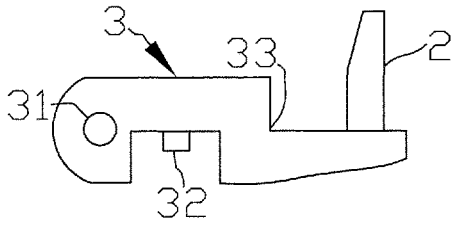
FIG. 1B is an illustration showing the moveable rod of the belt buckle of the present invention.
Figure 3:
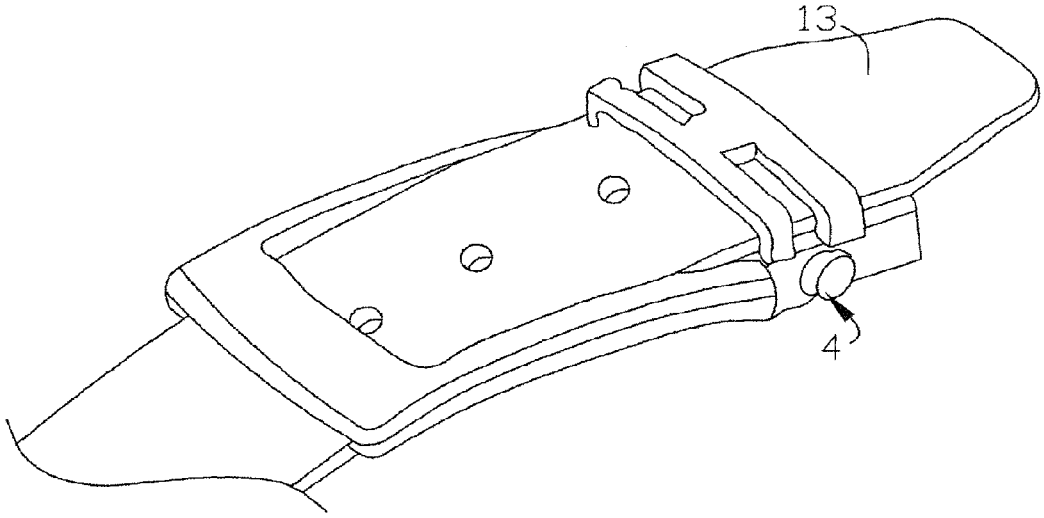
FIG. 3 is an illustration showing a state of use of a second embodiment of a push button type belt buckle of the present invention.
Figure 4:
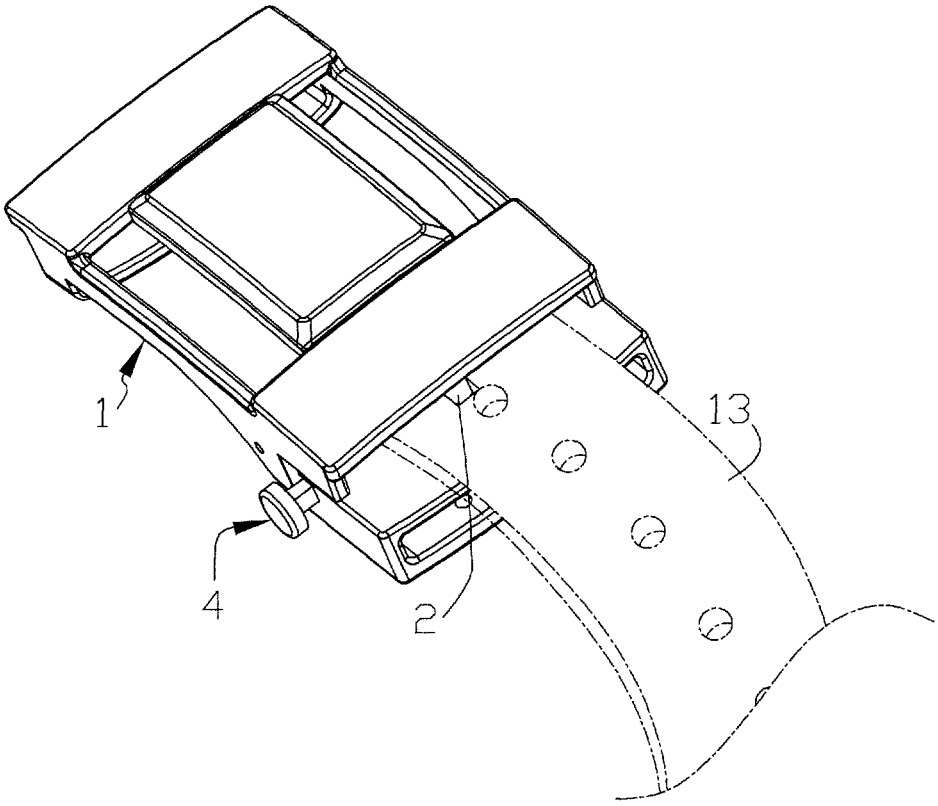
FIG. 4 is an illustration showing a state of use of a third embodiment of a push button type belt buckle of the present invention.
Figure 4A:
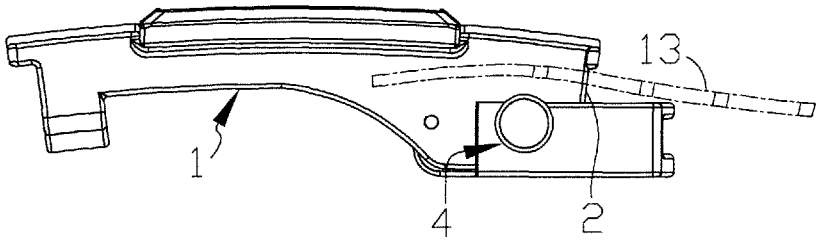
FIG. 4A is a side view showing an operation of the third embodiment of the belt buckle of the present invention.
Figure 4B:
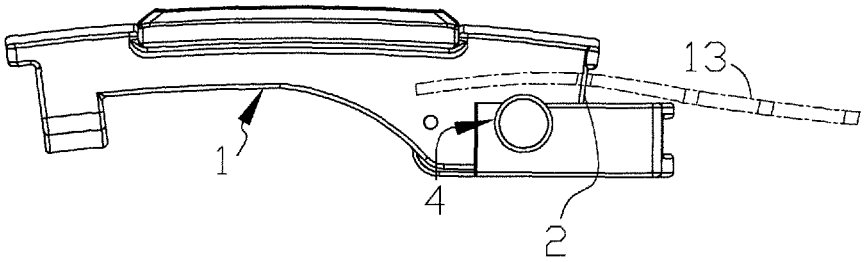
FIG. 4B is another side view showing an operation of the third embodiment of the belt buckle of the present invention.

As shown in FIG. 1 to FIG. 1B, in this embodiment of the push button type belt buckle of the present invention, the first positioning shaft 32 and the first spring 5 provided at the bottom of the moveable rod 3 together form the second spring mechanism 72 whereas the second positioning shaft 44 and the second spring 6 provided at the rear end of the extension 41 of the push button 4 together from the first spring mechanism 71; and wherein the vertical positioning surface 43 and the slanted opening 42 of the extension 41 of the push button 4 are arranged corresponding to the slot 33 of the moveable rod 3 to form an vertically interlaced arrangement with each other. As shown in FIG. 2 to FIG. 2B, when the push button 4 is not being pressed, the second positioning shaft 44 of the extension 41 would not cause the second spring 6 to be compressed while the vertical positioning surface 43 and the slanted opening 42 would not be abutting the moveable rod 3 at the top thereof such that the first spring 5 mounted onto the first positioning shaft 32 arranged at the bottom of the moveable rod 3 would not be compressed as well. As shown in FIG. 2C to FIG. 3, when the push button 4 is being pressed down, the second spring 6 is then compressed to cause the moveable rod 3 to move toward the slanted opening 42 while the entire body of the moveable rod 3 is being moved downward such that the buckling pin 2 is able to float within the internal of the belt base 1 in order to achieve the adjustment of the position of the buckling or fastening of the belt 13. As the first spring 5 is subject to a downward force, the position of the first spring 5 is restricted by the first positioning shaft 32 and the belt base to create a degree of curvature such that the operation of the pressing down of the button requires no great external forces and is free from possible jamming. When the belt 13 is buckled and fastened at a desired position, the first spring mechanism 71 and the second spring mechanism 72 are able to push back the button 4 and the moveable rod 3 to return to their original positions with their inherent elasticity and such that the adjustment thereof can be achieved with ease. As shown in FIGS. 4, 4A and 4B, when the push button 4 is pressed down to adjust the belt 13 for an alternation of the extent of the fastening and buckling, a locking state thereof can be achieved once the buckling hole and the buckling pin 2 are matched cooperatively; on the other hand, when the push button is not being pressed and when the buckling pin 2 is pushed upward to return to its original position without being aligned and matched with the buckling hole of the belt 13 due to the spring force of the first spring 5 arranged in the mechanism mentioned above, the belt 13 can be adjusted freely for any desired positions; in addition, once the buckling pin 2 is aligned and matched with the buckling hole, the buckling pin 2 can then be pushed upward to return to its original position due to the spring force to form a locking state thereof and such that a push button type belt buckle with improved structure and effects can be advantageously achieved.

What is claimed is:

1. A push button type belt buckle, comprising:

a belt base that is adapted to receive a belt movable with respect thereto in a predetermined moving direction;

a moveable rod movably received in an interior space of the belt base and having a rear end provided with a rotating axle rotatably mounted to the belt base, a front end provided with a buckling pin movable in a first direction with the rotation of the movable rod about the rotating axle and a slot, and a bottom portion to which a first positioning shaft is mounted to support a first spring mounted to the belt base for providing a first spring force to bias the buckling pin in the first direction substantially perpendicular to the predetermined moving direction of the belt to engage a buckling hole of the belt; and a push button having one side provided with an elongated extension to which a second positioning shaft is mounted to support a second spring mounted to the belt base for providing a second spring force in a second direction that is substantially perpendicular to the first direction and the predetermined moving direction of the belt, the elongated extension having a central portion provided with a vertical positioning surface and a slanted opening mutually fit to the slot of the moveable rod in such a way that the slanted opening is engageable with the movable rod to apply a camming action thereto;

wherein the push button is configured to selectively undergo a linear movement in the second direction against the second spring force so as to drive the moveable rod against the first spring force of the first spring through the camming action so that the moveable rod rotates about the rotating axle to cause the buckling pin to disengage from the buckling hole of the belt to show a floating condition.

* * * * *